US005720497A

United States Patent [19]

Lancellotti

[11] Patent Number: 5,720,497

[45] Date of Patent: Feb. 24, 1998

[54] WRITING AND GAME BOARD

[76] Inventor: Joseph Lancellotti, 8 Starr Rd., East Brunswick, N.J. 08816

[21] Appl. No.: 764,203

[22] Filed: Dec. 13, 1996

[51] Int. Cl.[6] ..... B42D 3/00

[52] U.S. Cl. ..... 281/45; 281/15.1; 281/51; 248/352

[58] Field of Search ..... 281/43, 45, 15.1, 281/51; 248/441.1, 352; 280/47.11; 285/115, 117

[56] References Cited

U.S. PATENT DOCUMENTS

| | | | |
|---|---|---|---|
| 2,420,673 | 5/1947 | Monrad | 283/115 X |
| 4,139,217 | 2/1979 | Jamison | 281/43 |
| 4,243,249 | 1/1981 | Goss | 281/43 X |
| 4,375,881 | 3/1983 | Mitchell | 281/45 X |

*Primary Examiner*—Willmon Fridie, Jr.
*Attorney, Agent, or Firm*—Plevy & Associates

[57] ABSTRACT

A writing board is adapted to be used with the steering wheel of a vehicle. The writing board has a board portion and a resilient member for securing the board portion to the steering wheel. The board portion has a planar platform having an upper edge, a lower edge, and a pair of side edges. The planar platform forms a first section and a second section. The planar platform is adapted to fold between the first and second sections and is adapted to rest upon the steering wheel. The board portion has a lip projecting upward from the lower edge and the side edges of the lower section. The lip is adapted to retain materials on the planar platform. A second lip projects downward from the upper edge adapted for positioning the planar platform on the steering wheel.

15 Claims, 5 Drawing Sheets

WRITING AND GAME BOARD

FIELD OF THE INVENTION

The invention relates to a portable writing board and more particularly to a portable writing board made of corrugated board that is adaptable to secure to a steering wheel of a vehicle.

BACKGROUND OF THE INVENTION

It is common to be stopped in a parking lot or other location and have the need or desire to fill out forms, complete paperwork, write a note, or engage in another task in which the person has a desire to have an even surface to work on.

It would be desirable to have a flat surface that can be used by a person sitting in the driver's seat which has a large work area, but is also readily stored and economical. It is also desirable that the surface be adaptable for other purposes.

SUMMARY OF THE INVENTION

This present invention is directed to a writing board adapted to be used with a steering wheel of a vehicle. The writing board has a board portion and a resilient member for securing the board portion to the steering wheel. The board portion has a planar platform having an upper edge, a lower edge, and a pair of side edges. The planar platform forms a first section and a second section. The planar platform is adapted to fold between the first and second sections and is also adapted to rest upon the steering wheel. The board portion has a lip projecting outward from the lower edge and the side edges of the lower section. The lip is adapted to retain materials on the planar platform. A second lip projects outward from the upper edge adapted for positioning the planar platform on the steering wheel.

One object, feature, and advantage resides in the second lip projecting downward from the upper edge for positioning the planar platform on the steering wheel.

Another object, feature, and advantage resides in the writing/game board being adaptable to be used as a game board with reattachable game pieces.

Further objects, features, and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
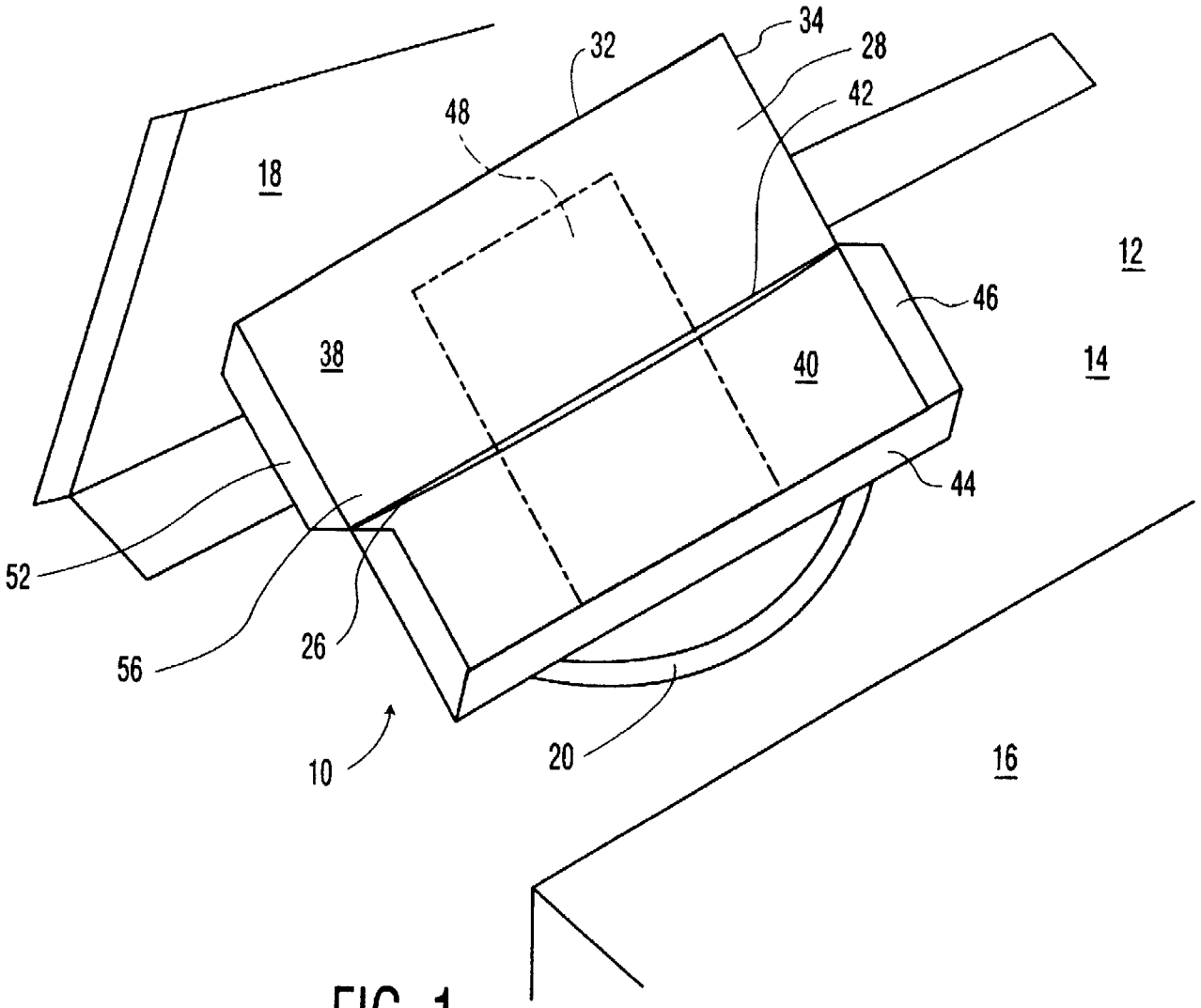
FIG. 1 is a perspective view of a writing/game board on a steering wheel in a vehicle.

Referring now to the drawings, wherein like numerals indicate like elements, and where prime (') indicates counterparts of such like elements, there is illustrated in FIG. 1 a perspective view of a writing/game board which has been identified by the numeral 10.

An interior 12 of a vehicle 14 with a driver's seat 16, a windshield 18, and a steering wheel 20 is shown in perspective in FIG. 1. The writing/game board 10 is shown secured to the steering wheel 20. The inventor does not condone the use of the writing/game board by the driver while the vehicle is moving and a suitable warning can be printed on the board.

The board 10 has a board portion 24 and a securing means portion 26. The board portion 24 has a planar platform 28 bounded by a bottom edge, not shown, a top edge 32, and a pair of side edges 34. The planar platform 28 is divided into a first, upper, section 38 and a second, lower, section 40 by a crease line 42. The securing means portion 26 is generally located at the crease line 42 of the board portion 24 for securing the board portion 24 to the steering wheel 20. In a preferred embodiment, the securing means 26 is a resilience linear object such as rubber band. The board can be thickened or otherwise treated to accommodate the band and provide stability.

The board portion 24 has a lower lip. The lower lip consists of a bottom edge lower lip 42 which projects upward from the bottom edge, not shown, and a side edge lower lip 44 which projects from the side edges 34 of the lower section 40. The lower lip 42 and 44 supports materials such as papers 48, shown in phantom, and pens and pencils.

The board portion 24 has an upper lip which consists of a top edge lip, not shown, which depends from the top edge 32 and a side edge lip 52 which depends from the side edges 34 of the upper section 38. Only the portion projecting from one of the side edges is shown.

Figure 2:
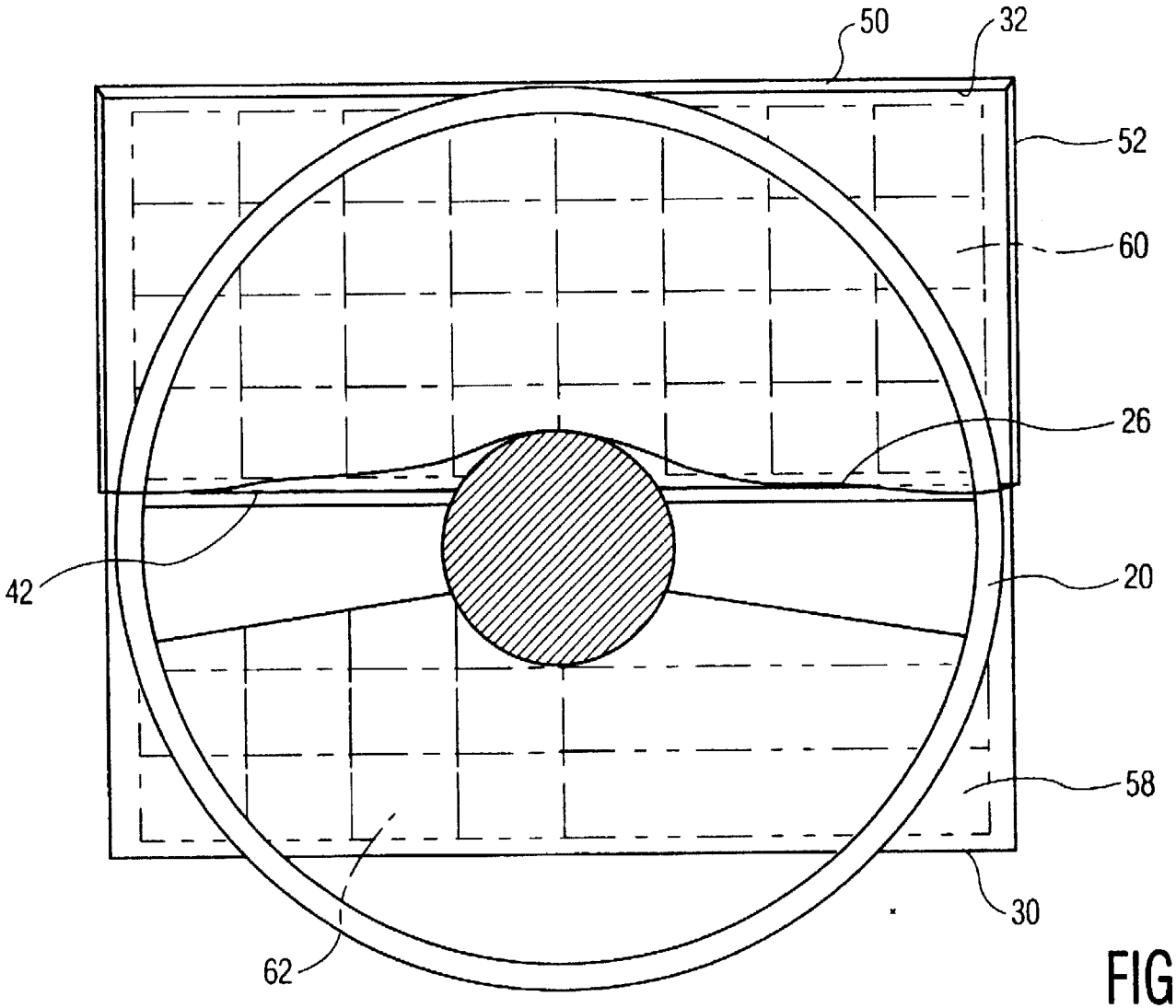
FIG. 2 is a back view of the writing/game board on the steering wheel.

FIG. 2 shows the board 10 from below the steering wheel 20. The upper lip 50 of the board portion 24 that depends from the top edge 32 engages the steering wheel 20 to assist in retaining the board portion 24 of the board 10 without moving downward relative to the steering wheel 20. While the two side lips 52, which are depending, are not shown engaging the steering wheel 20, the side lips 52 limit movement of the board portion 24 laterally relative to the steering wheel 20.

The rubber band 26 is seen extending around the steering wheel generally at the crease line 42 of the board portion 24 for securing it the steering wheel 20. The bottom edge 30 of the planar platform 30 can be seen in this Figure.

The planar platform 30 has two surfaces, which will be referred to as a first surface 56, shown in FIG. 1, and a second surface 58. One, both, or neither surface can have an image printed on it. In the embodiment shown, the second surface 58 has a board 60, shown in phantom, with sixty four (64) squares 62 printed on it for playing chess or checkers as explained below. Not all the squares are shown for clarity.

Figure 3:
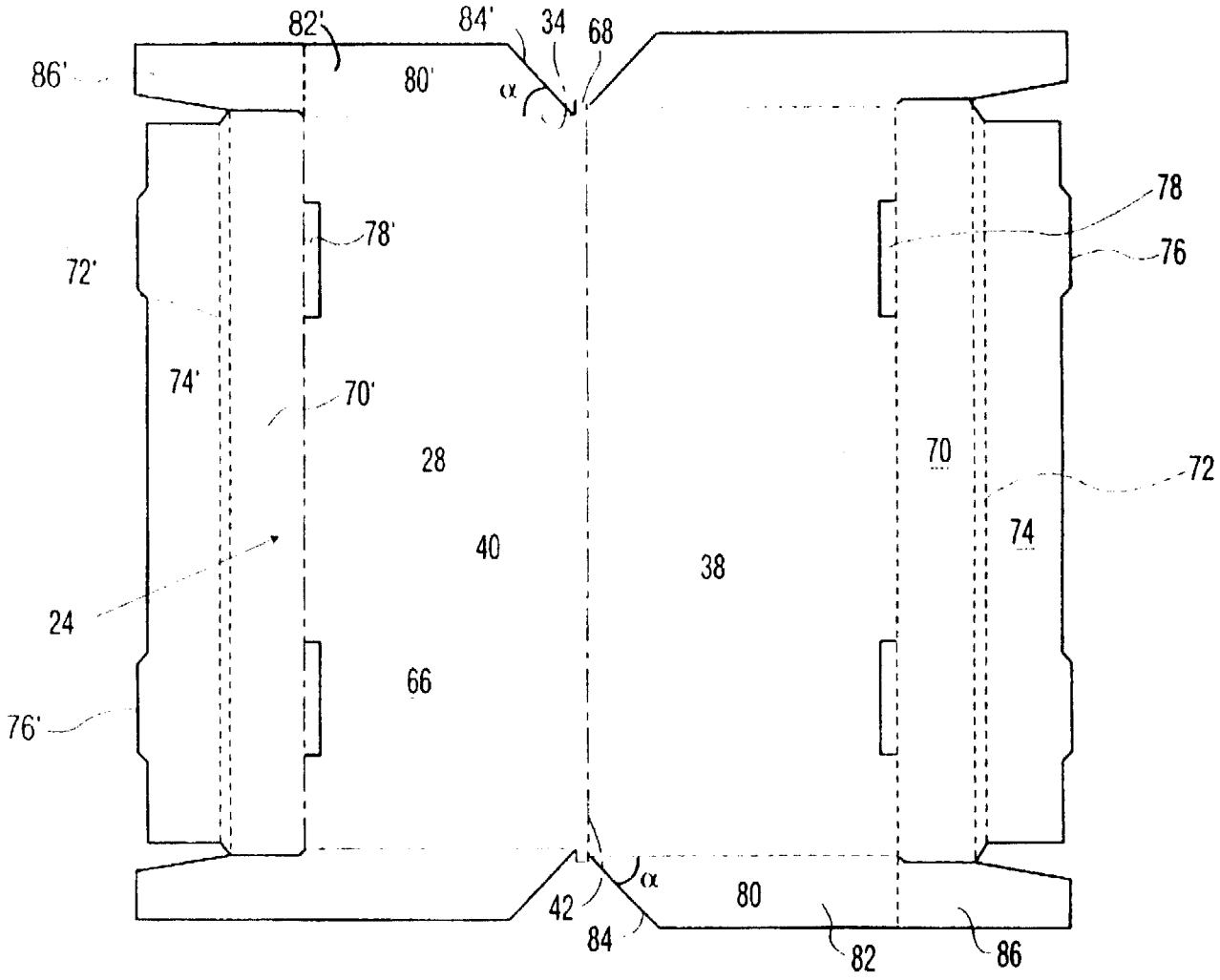
FIG. 3 is a plan view of the corrugated blank that forms the board portion of the writing/game board.

FIG. 3 shows the board portion 24 as a flat corrugated blank 66 prior to assembly. The flat corrugated blank 24 has the planar platform 28 with the first section 38 and the second section 40 with the crease line 42 interposed. Adjacent to the crease line 42 on the second section is a pair of tabs 68 projecting from the side edges 34 which fold in to stabilize area where board passes over.

Along the top edge 32 of the first section 38 is a series of flaps 70, 72, and 74 which form the top upper lip 50, as shown in FIG. 2. At the top of the third, upper, flap 74 are a pair of tabs 76 which are adapted to be received by a pair of slots 78 formed at the top edge 32 where the first flap 70 joins the first section 38.

Along each of the side edges 34 of the first section 38 is a flap 80. The flap 80 has an exposed portion 82 with an edge 84 which projects from the side edge at an angle α of approximately 45°. Extending from the exposed portion 82 of the flap 80 is a hidden portion 86 which is located in a channel 88 defined by the series of flaps 70, 72, and 74 when assembled. See FIG. 4B.

Along the bottom edge 30 of the second section 40 is a series of flaps 70', 72', and 74' which form the bottom lower lip 44, as shown in FIG. 1. At the bottom of the third, lower, flap 74' are a pair of tabs 76' which are adapted to be received by a pair of slots 78' formed at the top edge 32' where the first flap 70' joins the second section 40.

Along each of the side edges 34 of the second section 40 is a flap 80'. The flap 80' has an exposed portion 82' with an edge 84' which projects from the side edge at an angle α of approximately 45°. Extending from the exposed portion 82' of the flap 80' is a hidden portion 86' which is located in a channel defined by the series of flaps 70', 72', and 74' when assembled.

In a preferred embodiment, the first section 38 is approximately 15.95 inches by 6.75 inches. The second section 40 is approximately 15.65 inches by 6.25 inches. The side flaps 80 and 80' are approximately 1.5 inches wide, which results in the side lips 46 and 52 projecting upward or downward by that same distance.

The first flap 70 and 70' is approximately 1.65 inches in width. The second flap 72 and 72' is a narrow flap, approximately 0.225 inches in width, for defining the channel 88.

The third flap 74 and 74' is slightly narrower than the first flap and has the tabs 76 and 76' respectively, which are received by the slots 78 and 78,' respectively.

Figure 4B:
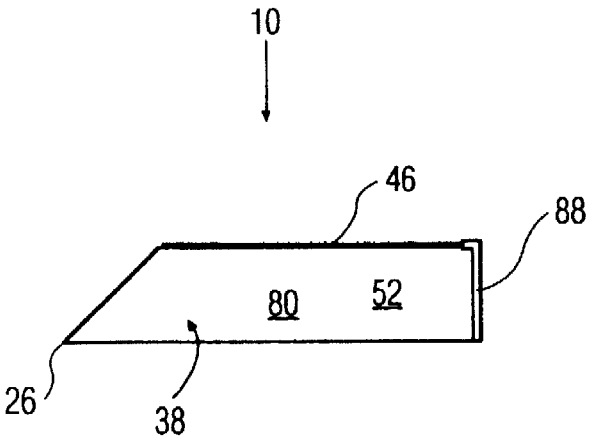
FIG. 4B is a side view of the writing/game board in the folded storage position.
Figure 4A:
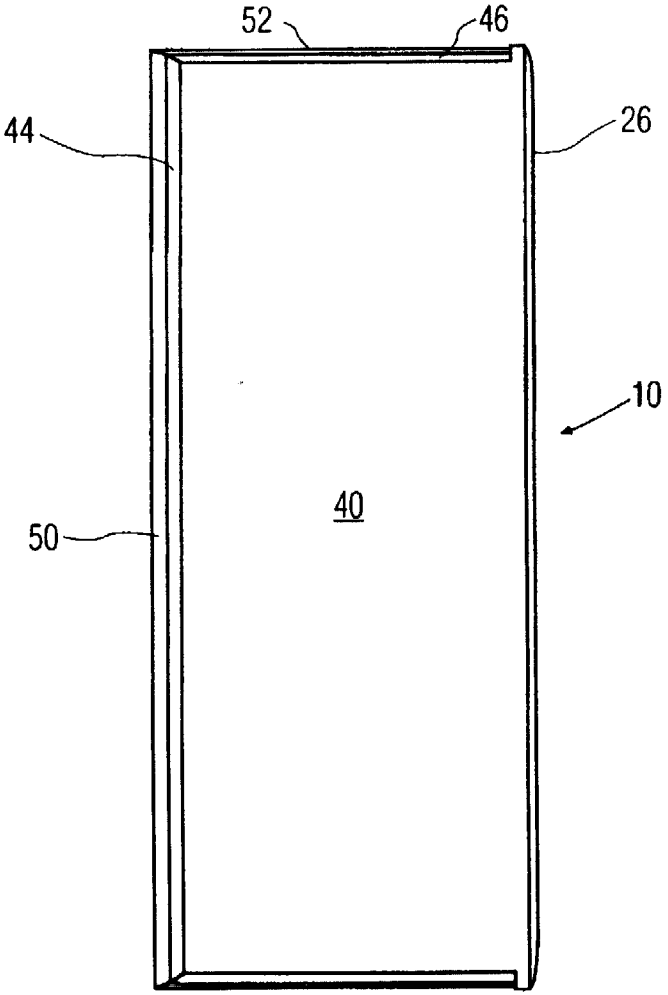
FIG. 4A is a top view of the writing/game board in a folded storage position.

The first section 38 is slightly larger than the second section 40 in both length (along the crease line 42) and depth (along the side edges 34) so that the second section 40 can be folded into the first section 38 as shown in FIGS. 4A and 4B. In this folded storage position, the writing/game board 10 can be stored in a conventional briefcase, not shown.

Figure 5:
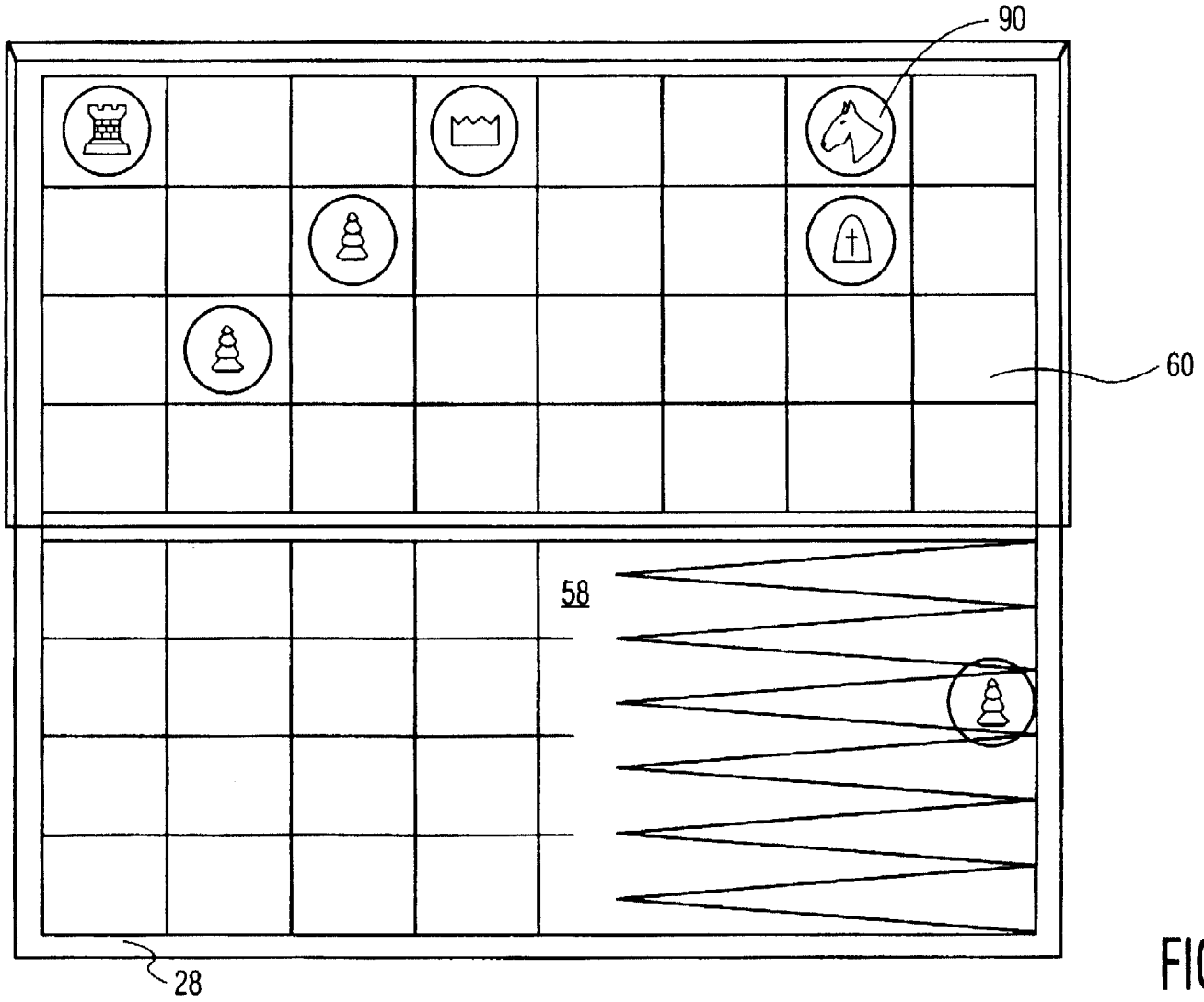
FIG. 5 is a view of the second surface of the board surface with a plurality of reattachable game pieces.

In addition to the writing/game board 10 being used as a writing board as shown in FIG. 1, the board portion 24 can be used to play games. Referring to FIG. 5, the planar platform 28 is shown with the board 60 on the second surface 58 having sixty four (64) squares 62, not all shown, printed on it for playing chess or checkers. The writing/game board 10 has a plurality of circular pieces 90 which are adapted to adhere to the game board 60.

It is recognized that other style boards, such as a backgammon, can also be printed on the platform 28. It is also recognized that the game board 60 could be covered with a felt or looped material and the pieces have hook material, such as sold under the trademark VELCRO to allow attachment.

The present invention may be embodied in other specific forms without departing from the spirit or essential attributes therefore and, accordingly, references should be made to appended claims, rather than to the foregoing specification, as indicating the scope of the invention.

It is claimed:

1. An article for creating a flat surface and adapted to be received by a steering wheel, the article comprising:

a platform having a planar surface, the planar surface having a lower edge and an upper edge;

a lip disposed relatively transverse to the upper edge and of sufficient width that the lip can extend over the top of the steering wheel; and attachment means coupled to the planar surface for securing the platform to the steering wheel.

2. An article as in claim 1, wherein the article further comprises a lip disposed relatively transverse to the lower edge and orientated such that it will project upwardly when the planar surface is placed over the front face of the steering wheel for retaining material on the platform.

3. An article as in claim 1 wherein the coupling means comprises a resilient member.

4. An article as in claim 3, wherein the resilient member is a rubber band.

5. An article as in claim 1 wherein at least one planar surface has a game board and the article further comprises a plurality of detachable game pieces adapted for use with the game board.

6. An article as in claim 5 wherein the game board surface has a smooth surface and the detachable game pieces have a light adhesive.

7. A writing board to be used with a steering wheel of a vehicle, the writing board comprising:

a board portion having a planar platform having an upper edge, a lower edge, a pair of side edges, and a first section and a second section, the planar platform further having a crease disposed between the first and second sections such that it will fold between the first and second sections, the planar platform being sized to substantially cover a steering wheel when placed over the front face of the steering wheel, the board portion having a lip disposed relatively transverse to the lower edge and orientated such that it will project upwardly when the planar surface is placed over the front face of the steering wheel for retaining materials on the planar platform; and a second lip disposed relatively transverse to the upper edge, in the direction opposite the first lip, and of sufficient width that the lip can extend over the top of the steering wheel; and attachment means coupled to edges of the planar member for securing the planar platform to the steering wheel.

8. A writing board as in claim 7 wherein the second lip of the board portion projects relatively transverse from both the upper edge and the side edges of the upper section, thereby forming a substantially C-shaped upper lip.

9. A writing board as in claim 7 wherein at least one planar surface of the board has a game board and the article further comprises a plurality of detachable game pieces adapted for use with the game board.

10. A writing board as in claim 9 wherein the game board surface has a smooth surface and the detachable game pieces have a light adhesive.

11. A writing board as in claim 9 wherein one of the game board surfaces and the game pieces have a loop surface and the other has a hook surface.

12. A writing board as in claim 7 wherein one of the sections of the planar platform is sized smaller than the other section of the planar platform such that, when the planar platform is folded along the crease, the surface of the smaller section can be pressed against the surface of the larger section without being obstructed by the lip projecting from the larger section.

13. A corrugated board configured to be folded into a writing board, the corrugated board comprising:

a planar platform having a first section bounded by a top edge and a pair of side edges, a second section bounded by a bottom edge and a pair of side edges, and an interposed crease line between the first and second sections;

a top flap extending from the top edge of the first section, the top flap further having a crease so that it can be folded to form an upper lip containing an inner channel;

a flap projecting from each of the side edges of the first section, each flap having an exposed portion with an edge which projects from the side edge, and a hidden portion extending from the exposed portion, the hidden portion being sized to be inserted into the inner channel defined by the top flap extending from the top edge;

a lower flap extending from the bottom edge of the second section, the lower flap further having a crease so that it can be folded to form a lower lip containing an inner channel; and a flap projecting from each of the side edges of the second section, each flap having an exposed portion with an edge which projects from the side edge, and a hidden portion extending from the exposed portion, the hidden portion being sized to be inserted into the inner channel defined by the lower flap extending from the bottom edge.

14. A corrugated board as in claim 13 further comprising a pair of tabs projecting from the side edges adjacent to the crease line.

15. A corrugated board as in claim 13 further comprising a plurality of tabs projecting from each of the flaps and a plurality of slots at the top edge and the bottom edge, the slots being sized to retain the plurality of tabs to form the inner channels.

* * * * *